US007357263B2

(12) United States Patent
Player

(10) Patent No.: US 7,357,263 B2
(45) Date of Patent: Apr. 15, 2008

(54) ARTICULATING JIB

(75) Inventor: Bryan Dana Player, Wake Forest, NC (US)

(73) Assignee: Altec Industries, Inc., St. Joseph, MO (US)

( * ) Notice: Subject to any disclaimer, the term of this patent is extended or adjusted under 35 U.S.C. 154(b) by 49 days.

(21) Appl. No.: 11/277,174

(22) Filed: Mar. 22, 2006

(65) Prior Publication Data

US 2007/0221599 A1 Sep. 27, 2007

(51) Int. Cl.
*B66C 23/42* (2006.01)

(52) U.S. Cl. ..... 212/300; 212/238; 212/261

(58) Field of Classification Search ..... 212/300, 212/238, 261
See application file for complete search history.

(56) References Cited

U.S. PATENT DOCUMENTS 2,674,500 A * 4/1954 Hukari ..... 182/2.7
3,077,720 A * 2/1963 Grove et al. ..... 56/328.1
3,286,855 A * 11/1966 Bill ..... 414/23
3,487,964 A 1/1970 Riley
3,774,789 A 11/1973 Klaus et al.
3,819,922 A 6/1974 Horn et al.
3,828,941 A * 8/1974 Coutinho ..... 212/261
3,917,088 A 11/1975 Visser
3,924,766 A 12/1975 Canning
3,953,960 A * 5/1976 Craven ..... 56/328.1
3,991,886 A 11/1976 Thorsell
4,027,772 A 6/1977 Garber
4,094,422 A 6/1978 Thompson
4,150,754 A 4/1979 Schmitt
4,178,591 A 12/1979 Geppert
4,222,491 A 9/1980 Geppert
4,252,213 A 2/1981 Ekman
4,368,824 A 1/1983 Thomasson
4,456,093 A 6/1984 Finley et al.
4,464,093 A 8/1984 Baron et al.
4,561,552 A * 12/1985 Sterner ..... 212/261
4,582,206 A * 4/1986 Johnson ..... 212/264
4,660,729 A 4/1987 Carbert
4,838,381 A 6/1989 Michaud et al.
4,861,224 A 8/1989 Holmes
4,927,315 A 5/1990 Nespor
5,183,168 A * 2/1993 Fujimoto ..... 212/232
5,337,854 A 8/1994 Brandt (Continued)

FOREIGN PATENT DOCUMENTS

CA 1198691 12/1985

(Continued)

*Primary Examiner*—Thomas J Brahan
(74) *Attorney, Agent, or Firm*—Hovey Williams LLP

(57) ABSTRACT

An improved boom-mounted jib unit (10) is provided having an increased range of motion and work envelope, which allows a user to lift heavier loads an otherwise work with less jib interference, as compared with prior jib units. The jib unit (10) includes a base (12) and a mounting component (28) permitting the unit (10) to be detachable secured to the upper end of a primary boom (22). The unit (10) also has a boom arm (14) made up of upper and lower arms (16, 18). The arm (14) is articulated by a dual piston and cylinder assembly (20) having first and second piston and cylinder assemblies (84, 86) coupled between the base (12) and arm (14).

12 Claims, 4 Drawing Sheets

U.S. PATENT DOCUMENTS

| | | | | |
|---|---|---|---|---|
| 5,507,107 | A * | 4/1996 | Pinomaki | 37/403 |
| 6,044,991 | A | 4/2000 | Freudenthal et al. | |
| 6,843,383 | B2 | 1/2005 | Schneider et al. | |
| 6,860,396 | B2 | 3/2005 | Seppala | |
| 2004/0164042 | A1 | 8/2004 | Schneider et al. | |
| 2004/0262078 | A1 | 12/2004 | Bailey | |

FOREIGN PATENT DOCUMENTS

| | | |
|---|---|---|
| DE | 2807518 C3 | 9/1981 |
| EP | 1000802 A1 | 5/2000 |
| EP | 1512388 A1 | 9/2005 |
| JP | 2-117590 | 5/1990 |

* cited by examiner

ARTICULATING JIB

BACKGROUND OF THE INVENTION

1. Field of the Invention

The present invention is broadly concerned with improved jib units of the type which may be mounted on a primary boom to allow a user to lift loads and do other work from a personnel bucket secured to the boom. More particularly, the invention is concerned with such detachable, boom-mounted jib units having a significantly increased range of motion and useful working envelope by provision of a doubly articulating assembly for selective movement of the jib unit when positioned on a boom. Double articulation is provided by means of first and second piston and cylinder assemblies pivotally coupled between the base of the jib unit and the moveable jib arm.

2. Description of the Prior Art

Arial booms are used in a variety of contexts in order to raise and lower heavy loads and allow workers to operate from boom-mounted personnel buckets and the like. For example, a vehicle-mounted arial device typically includes a boom which can rotate, pivot up and down, and extend. The boom assembly generally has a lower boom mounted to the vehicle and an upper boom which articulates relative to the lower boom. The tip of the upper boom carries a working platform such as a bucket or basket from which workers can perform various jobs. It is common for this type of arial device to be used in situations requiring the raising and lowering of heavy loads. This task is usually carried out by means of a pivotal jib unit mounted on the tip of the upper boom, with the jib unit supporting a winch assembly.

U.S. Pat. No. 6,044,991 illustrates such an arial boom device. The jib unit described in the '991 patent has a single piston and cylinder assembly for articulation of the jib arm. This inherently limits the range of motion and useful work envelope of the jib unit. A problem commonly encountered in such cases is that when lifting heavy loads, the jib unit must be positioned in such a location that the load cannot be elevated to a convenient work height. Thus, the user may be forced to bend over the edge of the bucket in order to manipulate the load. This is not only inconvenient, but effectively lessens the loads which the user may be able to handle.

The prior art describes a vast array of boom designs, both in mobile vehicle-mounted booms and in static units. Some of these designs are illustrated in Patents and Patent Publications Nos. U.S. Pat. Nos. 4,150,754, 3,774,389, 3,917,088, 4,464,093, 4,660,729, 4,927,315, 6,860,396, 4,027,772, 3,924,776, 4,094,422, 3,991,886, 3,487,964, 4,252,213, 4,222,491, 4,368,824, 4,861,224, 4,456,093, 2004/0262078, 2004/0164042, 3,819,922, 6,843,383, 5,337,854, 4,178,591, 4,582,206, 5,826,859, 4,828,124, 4,053,060, 5,337,854, 4,838,381, 4,063,649, 2,988,040, 4,759,685, GB2148983, GB1400402, DE2807518, DE3633582, DE29801914, DE29619474, DE4203186, DE3112586, SE521093, WO94/27906, EP1512388, EP1000802, and EP0513939.

SUMMARY OF THE INVENTION

The present invention overcomes the problems outlined above and provides an improved jib unit of the type designed for detachable connections to the upper end of a primary boom in order to afford greater ranges of motion and useful work envelopes. Broadly speaking, the jib units of the invention comprise a jib arm and a stationary base including coupling structure for selective attachment and detachment of the jib unit to a primary boom upper end. The jib units also includes an articulating assembly operably coupled between the stationary base and jib arm in order to selectively move the jib arm relative to the base. This articulating assembly includes first and second piston and cylinder assemblies operatively pivotally coupled between the stationary base and the jib arm, so that the jib arm is movable in response to extension and retraction of the first and second piston and cylinder assemblies.

In preferred forms, the jib-mounting coupling structure includes a cylindrical body configured to be received within a socket carried by the upper end of the primary boom. For example, the boom may be equipped with a leveling device for maintaining a personnel bucket in a horizontal position throughout the range of movement of the boom; and this device may be configured to include a socket adapted to receive the cylindrical coupling structure of the jib unit.

The doubly articulating assembly of the jib unit preferably includes a lower jib arm and an upper jib arm pivotally coupled with the lower jib arm. The lower jib arm is pivotally coupled with the stationary base. In detail, the first assembly is pivotally coupled with the stationary base and the lower jib arm, whereas the second assembly is secured to the lower jib arm and the upper jib arm. In order to minimize the dimension envelope of the articulating assembly, the lower jib arm is positioned between the first and second piston and cylinder assemblies.

DETAILED DESCRIPTION OF THE PREFERRED EMBODIMENT

Figure 1:
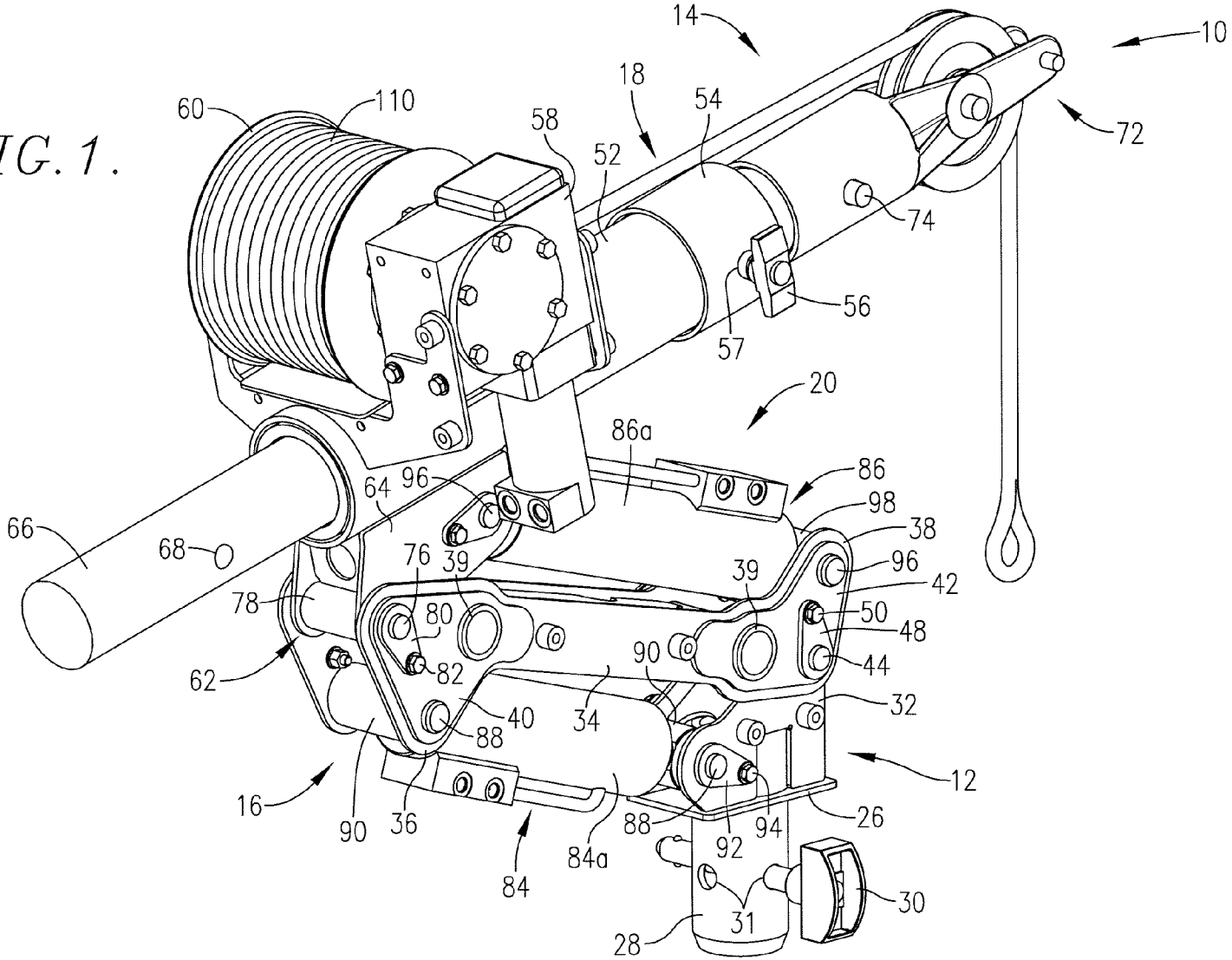
FIG. 1 is a perspective view of a preferred jib unit in accordance with the invention, showing the stowed condition of the unit.

Turning now to the drawings, a jib unit incorporating principles of the present teachings is illustrated in FIG. 1 and designated generally by the reference numeral 10. Broadly, the jib unit 10 includes a stationary base 12, a jib arm 14 including a lower arm 16 and an upper arm 18, and an articulating assembly 20 operably coupled between base 12 and arm 14 in order to selectively articulate the latter through an extended range of motion. The jib unit 10 is especially designed to be detachably mounted on the upper end of a primary boom 22 (see FIGS. 2 and 3) which also supports a personnel bucket 24.

In more detail, the base 12 includes a generally horizontal plate 26 supporting a depending, generally cylindrical mounting component 28 carrying a removable locking pin 30; the pin 30 may be alternatively received within a plurality of mounting through-hole pairs 31. The illustrated through-hole pairs 31 represent substantially orthogonal positions, but more through-hole pairs may be used representing a variety of positions without departing from the scope of the claimed invention. The base 12 also includes a pair of upstanding, laterally spaced apart side frames 32 that are substantially parallel to each other. The horizontal plate 26 and the side frames 32 support the weight of the jib arm 14 and the articulating assembly 20, as well as any external load on the jib arm 14, and are therefore constructed of a sturdy and rigid material, such as steel or iron. Reinforcing webs (not shown) extend between the side frames 32 to provide additional rigidity to the base 12.

The horizontal plate 26 is preferably between one-sixteenth and one inch thick, and more preferably between one-eighth and one-quarter of an inch thick. Each of the side frames 32 is likewise preferably between one-sixteenth and one inch thick, and more preferably between one-eighth and one-quarter of an inch thick.

Figure 8:
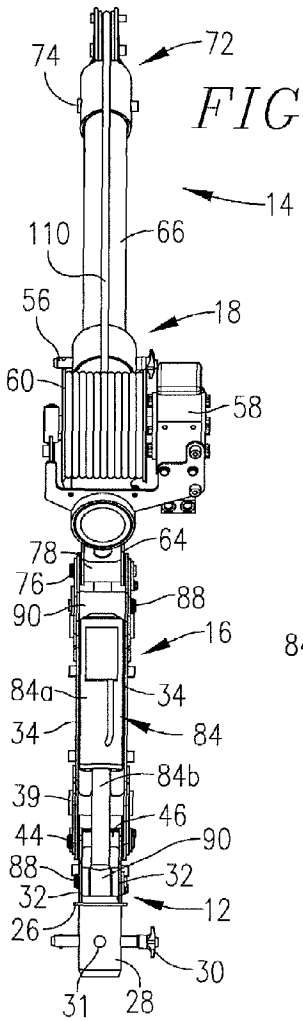
FIG. 8 is an end view of the unit shown in FIG. 7.

The lower arm 16 comprises a pair of elongated, laterally spaced apart, unitary arms 34 each presenting endmost extensions 36 and 38 separated longitudinally by an elongated and narrower center portion. The endmost extension 36 is substantially downwardly-extending and the endmost extension 38 is substantially upwardly-extending when the jib unit 10 is in the position illustrated in FIG. 1. As illustrated in FIG. 8, the arms 34 are substantially parallel to each other and of substantially identical shape and size.

Outboard reinforcement plates 40 and 42 are provided at the regions of the extensions 36 and 38, and additional reinforcements including cross tubes 39 are interconnected between the arms 34 along the lengths thereof. The reinforcing places 40 and 42 may comprise separate plates rigidly secured to the arms 34, or may comprising raised portions of the arms 34 integrally formed with the arms 34. The lower arm 16 is pivotally coupled to upper ends of the side frames 32 of the base 12. To this end, a laterally extending pivot pin 44 extends through the lower extensions 38 and the corresponding reinforcements 42, as well as through a journal fitting 46 located between the side frames 32. The outboard ends of pivot pin 44 are equipped with lobes 48 secured to the adjacent reinforcement 42 by screw 50. Hence, the lower arm 16 is pivotal about a generally horizontal axis and relative to base 12.

The arms 34 are preferably between six inches and three feet in length, more preferably between eight and twenty inches in length; and preferably between one-sixteenth inch and one-half inch in thickness, more preferably between one-eighth and one-half inch in thickness, excluding the reinforcing plates 40 and 42, which preferably substantially double the thickness of the arms 34. The shape of the arms 34 illustrated in the various drawings is exemplary, and not limiting, in nature, and it will be appreciated that the arms 34 may be constructed with various different shapes without departing from the scope of the claimed invention.

Upper arm 18 includes a tubular body 52 having an outermost reinforcing sleeve 54 carrying a hand-actuated positioning pin 56 which is insertable into a through-aperture 57. The body 52 also supports a hydraulically operated winch and motor assembly 58 and an associated reel 60. A mounting bracket 62 depends from the underside of body 52 and includes a pair of laterally spaced apart side plates 64. A tubular extension 66 is slidably received within body 52 and has a pair of spaced apart, pin-receiving positioning apertures 68 and 70.

The extension 66 is thus movable between a retracted, stowed position (see FIGS. 1-3) where the pin 56 is inserted through sleeve 54 and positioning aperture 70, and an extended use position where the extension 64 is shifted outwardly and pin 56 extends through sleeve 54 and positioning aperture 68 (see FIGS. 4-8). The outermost end of extension 66 is also designed to support a detachable working implement such as a pulley unit 72, secured in place by a detachable pin 74. The aperture 68 is spaced a sufficient distance from an end of the tubular extension 66 to prevent the creation of a damaging moment between the overlapping portions of the body 52 and the extension 66 when the extension 66 is in the extended use position and supporting a load via the pulley unit 72 or other working implement.

The body 52 of the upper arm 16 is preferably between six inches and three feet in length, more preferably between twelve inches and eighteen inches in length. The tubular extension 66 is preferably between two feet and twelve feet in length, more preferably between three feet and five feet in length. The diameter of the tubular extension 66 is preferably between one inch and twelve inches in diameter, more preferably between two inches and five inches in diameter. Furthermore, the tubular extension 66 may be substantially solid or substantially hollow.

The upper arm 18 is pivotally coupled to lower arm 16 by means of pivot pin 76 extending through the outer ends of the extensions 36 and reinforcements 40, and also through journal 78 extending between the extensions 36. The pin 76 also has outboard locking lobes 80 secured to the adjacent reinforcements 40 by screws 82. Hence, the upper arm 18 is pivotal about a generally horizontal axis and relative to the lower arm 16.

The articulating assembly 20 includes first and second, hydraulically driven, double acting piston and cylinder assemblies 84, 86 (each having a cylinder 84*a*, 86*a* and an extensible rod 84*b*, 86*b*) which are operatively coupled between base 12 and jib arm 14. In particular, the first piston and cylinder assembly 84 has its rod end pivotally coupled with base 12, with the cylinder end thereof pivotally secured to extension 36 of lower arm 16. The rod and cylinder ends are pivoted by means of pivot pins 88 extending through the apertured side frames 32 and the apertured extensions 36. Each pivotal connection also includes a journal fitting 90 located between the side frames 32 and the extensions 36. Outboard locking lobes 92 are affixed to the ends of lower pin 88, and are secured by bolts 94.

Similarly, the second piston and cylinder assembly 86 is pivotally coupled between the extension 38 and bracket 62 of the jib arm 14, with the rod end of the assembly 86 secured to the bracket 62, and the cylinder end of the assembly coupled to the extensions 38. To this end, pivot pins 96 extend through the reinforcement plates 42 and extensions 38, and through the side plates 64 of the bracket 62. Journal fittings 98 are located between the extensions 38 and side plates 64. Each of the piston and cylinder assemblies 84, 86 is convention in nature and may be, for example, hydraulically actuated via hydraulic line inputs illustrated in the drawings, and in particular in FIG. 1.

Figure 4:
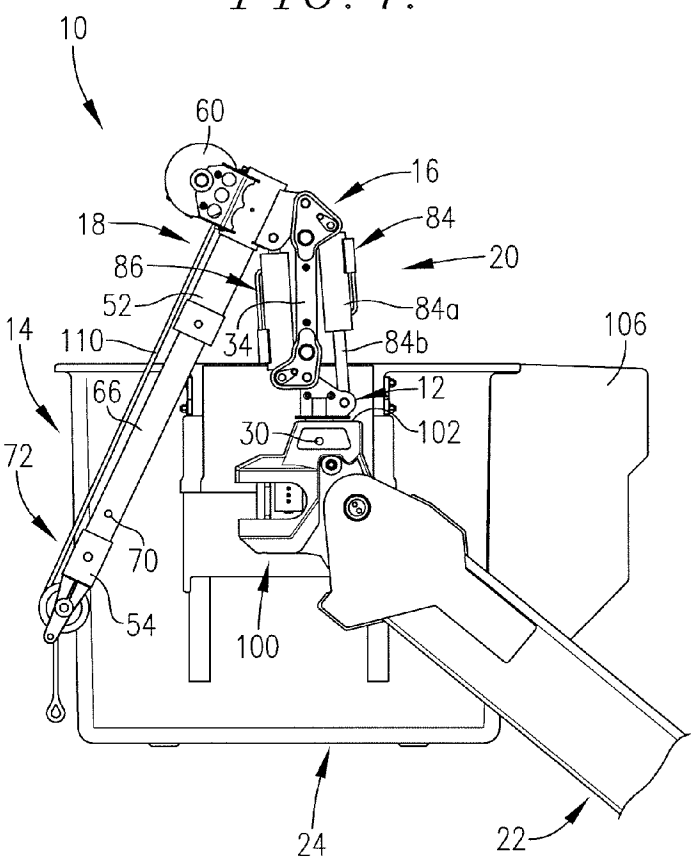
FIG. 4 is an enlarged, side elevational view of the unit depicted in FIGS. 2 and 3, but showing the jib unit fully extended and in its lowermost position.

Extension of the first assembly 84 causes the lower arm 16 to pivot relative to the stationary base 12 about pivot pin 44 from a position substantially perpendicular to a longitudinal axis of the cylindrical mounting component 28 (see FIG. 1) to a position substantially parallel with the axis of the cylindrical mounting component 28 (see FIG. 4). Conversely, retraction of the first assembly 84 causes the lower arm 16 to pivot relative to the stationary base 12 about the pivot pin 44 from the position substantially parallel with the axis of the cylindrical mounting component 28 to the position substantially perpendicular to the axis. It will be appreciated that the first assembly 84 may selectively assume any position from a fully retracted position to a fully extended position.

Figure 7:
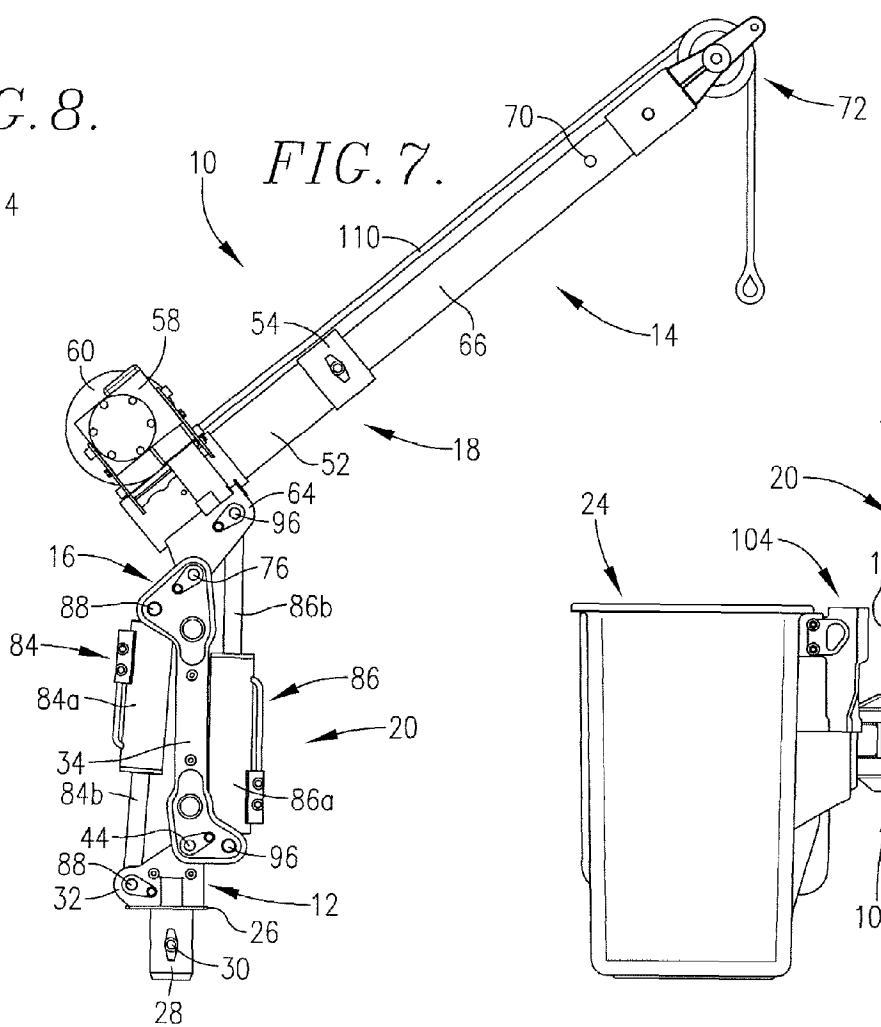
FIG. 7 is a side elevational view of the jib unit, shown fully extended and in a load-lifting position.

Extension of the second assembly 86 causes the upper arm 18 to pivot relative to the lower arm 16 about pivot pin 76 from a position wherein the upper arm 18 and the lower arm 16 form an acute angle (see FIG. 1) to a position wherein the upper arm 18 and the lower arm 16 form an obtuse angle (see FIG. 7). Conversely, retraction of the second assembly 86 causes the upper arm 18 to pivot relative to the lower arm from the position wherein the upper arm 18 and the lower arm 16 from an obtuse angle to the position wherein the upper arm 18 and the lower arm 16 form an acute angle. It will be appreciated that the second assembly 86 may selectively assume any position from a fully retracted position to a fully extended position.

The primary boom 22 is entirely conventional and may be an articulated "knuckle" boom or a multiple section extensible boom. The boom 22 carries at its upper end a conventional bucket leveling device 100 which is secured to the personnel bucket 24 and serves to maintain the bucket level during all movement of the boom. The device 100 includes an upper mounting surface 102 with an downwardly extending socket (not shown). This socket is designed to receive the component 28 of jib unit 10, with the locking pin 30 extending thought the socket-defining body of the device 100 and through one of the locking holes 31, to detachably mount the jib unit 10 to boom 22. Note that the unit may be mounted in two positions relative to bucket 24, by selection of an appropriate mounting hole 31. Furthermore, the locking pin 30 is hand-removable, thus enabling a user to quickly and easily rotate the unit 10 relative to the personnel bucket 24 by withdrawing the locking pin 30 from the cylindrical mounting component 28, rotating the unit 10 until the mounting holes 31 are in registry with corresponding mounting holes of the socket (not shown), and inserting the locking pin 30 to lock the unit 10 into the desired position.

Figure 3:
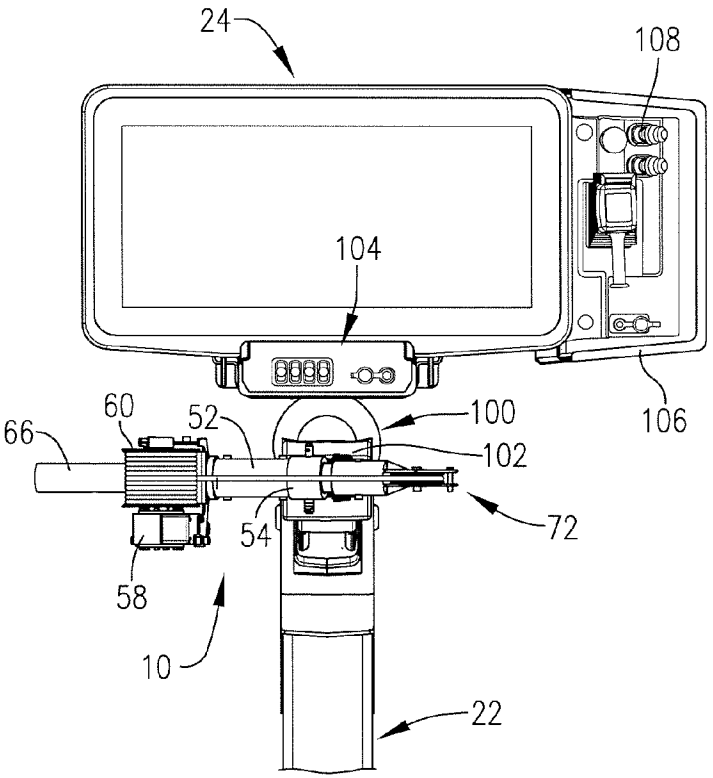
FIG. 3 is a plan view of the jib unit, primary boom, and personnel bucket depicted in FIG. 2.

The personnel bucket 24 is designed to hold a worker and allow the worker to manipulate both primary boom 22 and jib unit 10. Accordingly, as best seen in FIG. 3, operator controls 104 for the boom 22 are mounted adjacent the inner sidewall of the bucket. Additionally, a supplemental housing 106 is attached to the sidewall of bucket 24, with the housing 106 having controls 108 for the jib unit 10. The controls 104 and 108 are conventional controls that may include, for example, joy-stick levers or similar hand-actuated levers or buttons. Furthermore, the controls 104 and 108 may be purely mechanical controls, may be electronic in nature, or may include a combination of mechanical and electronic elements.

In the embodiment illustrated in FIGS. 1-5 and 7-8, the pulley unit 72 is mounted on the outboard end of extension 66. Also, nylon rope 110 is wound about reel 60 with the free end of the rope trained about pulley unit 72.

Figure 2:
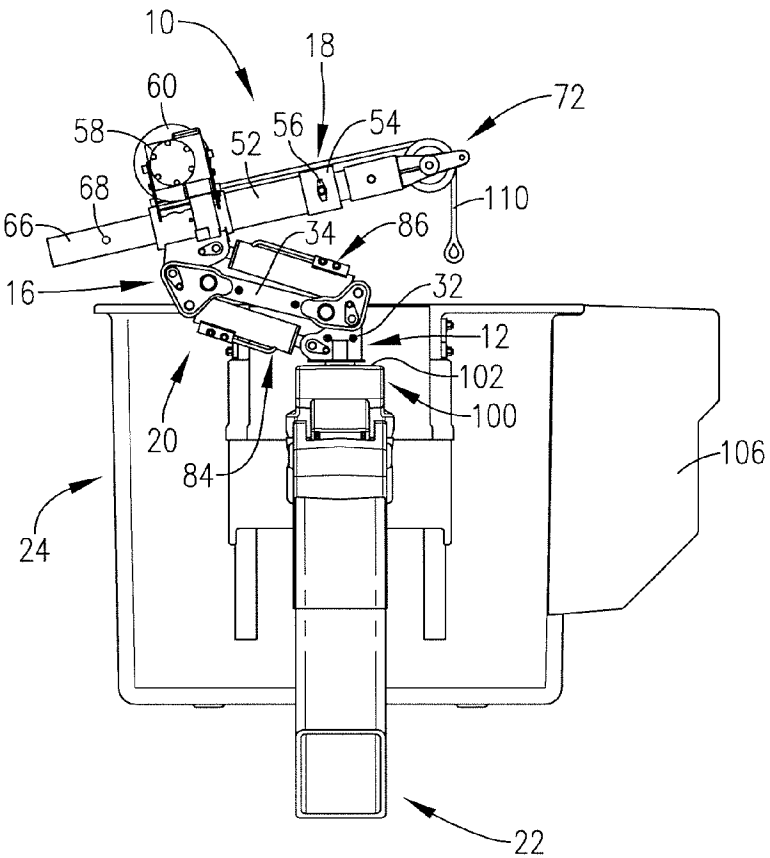
FIG. 2 is a side-elevational view of the preferred jib unit, shown mounted on a primary boom adjacent a personnel bucket.

When the jib unit 10 is not in use, it may be conveniently placed in a stowed position illustrated in FIGS. 1-3. In this orientation, the assembly 20 is operated so as to retract both of the piston rods 84*b*, 86*b*, and the extension 66 is moved to its retracted position. This involves detachment of positioning pin 56 and manual retraction of the extension 66 until the positioning aperture 70 comes into alignment with the pin aperture 57. At this point, the pin 56 is reinserted to lock the extension 66 in its retracted position.

Figure 5:
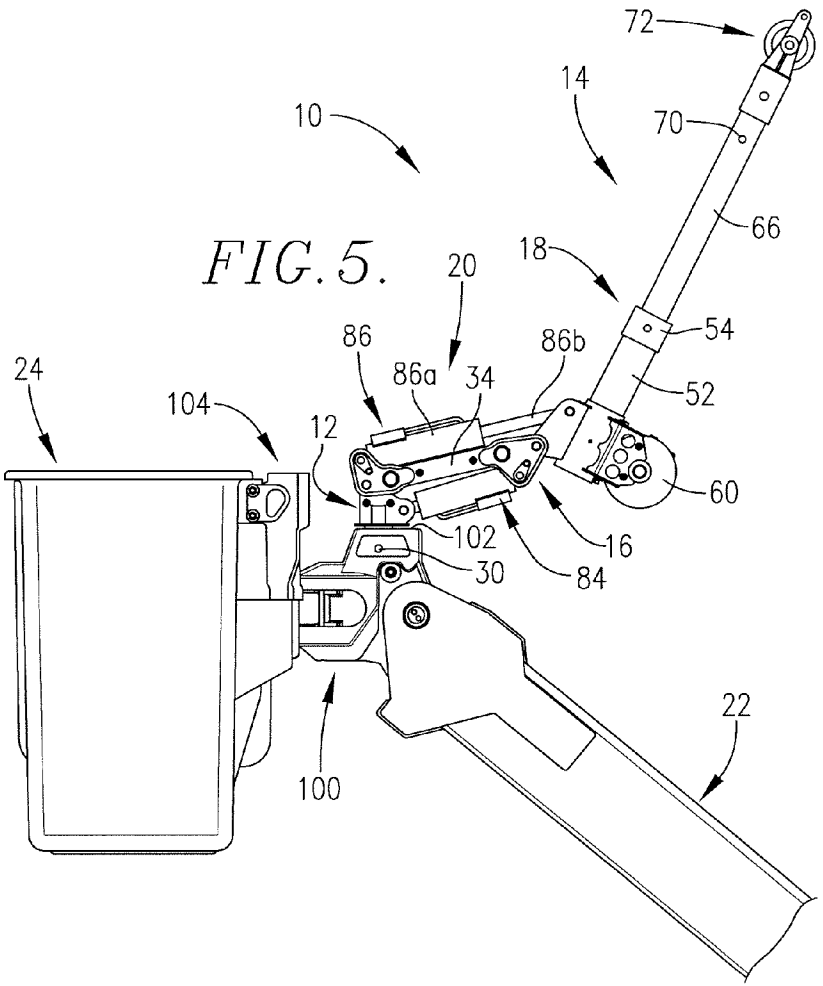
FIG. 5 is a view similar to that of FIG. 4, but showing the jib unit fully extended, FIGS. 4 and 5 together illustrating the range of motion of the jib unit.
Figure 6:
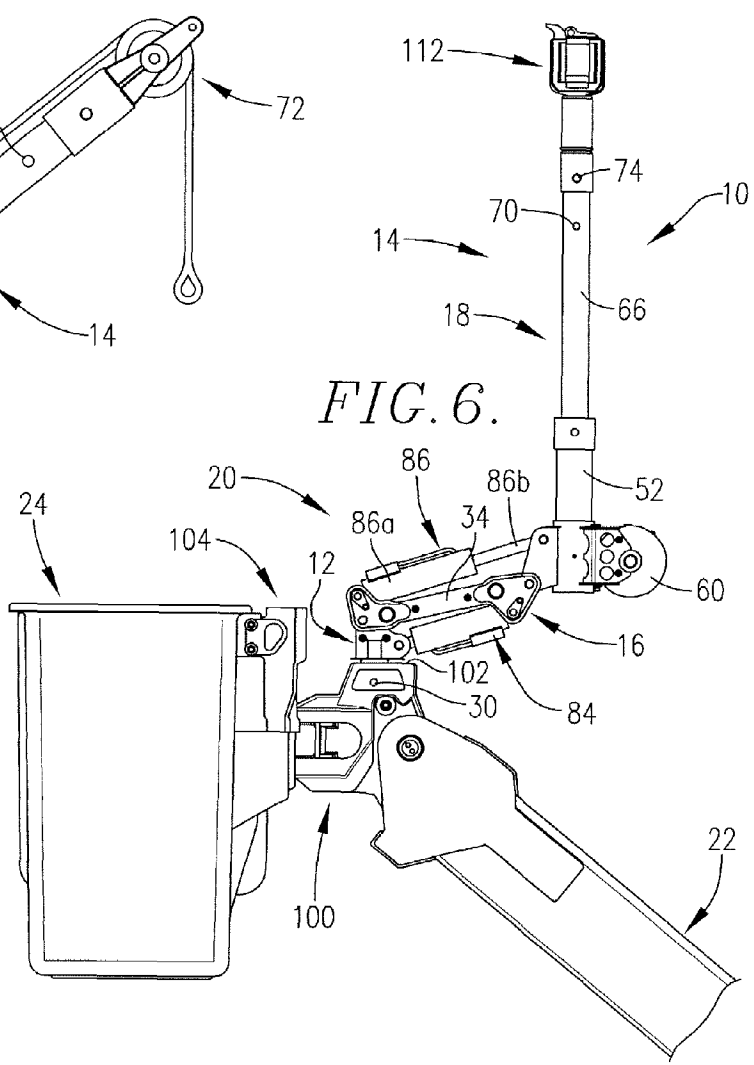
FIG. 6 is an end view of the unit shown in FIGS. 4 and 5, but showing the jib arm in its vertical position and carrying a phase-line lifter.

When it is desired to use the jib unit 10, the above procedure is reversed, i.e, the locking pin 57 is removed, extension 66 is manually shifted outwardly until aperture 68 comes into registry with aperture 57, and pin 56 is reinserted. At this point, the user may manipulated the controls 108 in order to move jib arm 14 to desired work locations. The opposite ends of the range of movement of arm 14 are shown in FIGS. 4 and 5. A typical load-lifting position is illustrated in FIG. 7, allowing the user to lift loads up to a convenient height relative to bucket 24. FIG. 6 depicts a situation where the jib unit 10 is used to elevate phase lines during work around such lines. In this instance, a known phase lifter device 112 is attached to the outer end of extension 66 in lieu of the pulley unit 72.

If desired, a load chart can be displayed adjacent the controls 108 to assist the user, with this display having only one value per jib unit position, based upon the position of the jib arm 14 and the boom angle. Such a single-value load chart eliminates the need for the user to interpolate between multiple charts based on angle, position, or distance of boom and jib components, and load line. Moreover, an electronic version would gather input from angle sensing accelerometers positioned on the lower and upper arms of the jib arm 14, and on the boom 22. A jib sensor could also be attached to the jib arm 14 to determine the length of the jib in use. Based upon a combination of these inputs, a single allowable load could be displayed to the user.

The jib unit 10, making use of a doubly articulated assembly 20, provides a working envelope significantly greater than that possible with only a single articulating design. Moreover, the jib unit 10 does not require pinning, unpinning, and repinning to achieve its maximum envelope of usage, as is common with singly articulating, extendable jib unit designs.

The invention claimed is:

1. An articulating jib unit adapted for coupling with the upper end of a primary boom, said jib unit comprising:

a jib arm;

a base including coupling structure for said coupling of the jib unit to said primary boom upper end; and an articulating assembly operably coupled between said base and jib arm to selectively move the jib arm relative to said base, said assembly including, a first piston and cylinder assembly having a rod presenting a rod end and a cylinder presenting a cylinder end and generally extending from the base, a second piston and cylinder assembly having a rod presenting a rod end and a cylinder presenting a cylinder end, an arm, having first and second ends, disposed between the first and second piston and cylinder assemblies, and first and second mounting units associated with the first and second ends of said arm, said one of the first assembly's rod end and cylinder end being pivotally associated with the base, and the other of said first assembly's rod end and cylinder end being pivotally associated with one of the first and second mounting units, said one of the second assembly's rod end and cylinder end being pivotally associated with the other of said first and second mounting units, and the other of said second assembly's rod end and cylinder end being pivotally associated with the jib arm, said first and second piston and cylinder assemblies being positioned approximately parallel to each other throughout extension and retraction of the rod ends of the assemblies and further oriented such that the rods of each of the assemblies extend in generally opposite directions.

2. The jib unit of claim 1, said coupling structure including a body configured to be received within a socket having a vertical longitudinal center line and located between said primary boom upper end and a personnel bucket.

3. The jib unit of claim 1, said jib arm supporting an elongated extension selectively shiftable between a storage position and a use position.

4. The jib unit of claim 1, wherein said articulating assembly operable to pivot approximately 180° about a generally horizontal axis relative to the base and further operable to pivot approximately 180° about a generally vertical axis relative to the base, and said jib arm being pivotally coupled with said articulating assembly, such that said jib arm is operable to pivot approximately 180° about the generally horizontal axis relative to the base upon extension and contraction of the first and second piston and cylinder assemblies.

5. The combination comprising:

a primary boom presenting an upper end; and a jib unit detachably coupled with the upper end of said primary boom, said jib unit including— a jib arm, a base including coupling structure for coupling of the jib unit to said primary boom upper end, and an articulating assembly operably coupled between said base and jib arm to selectively move the jib arm relative to said base, said assembly including— a first piston and cylinder assembly coupled to the base and having a rod presenting a rod end and a cylinder presenting a cylinder end, and a second piston and cylinder assembly coupled to the jib arm and having a rod presenting a rod end and a cylinder presenting a cylinder end, said first and second assemblies positioned approximately parallel to each other throughout extension and contraction of the rods of the assemblies and further oriented such that the rods of each of the assemblies extend in generally opposite directions, said articulating assembly being compact, such that said cylinder of the second assembly at least partially overlies said cylinder of the first assembly when the rods of the first and second piston and cylinder assemblies are in a retracted position.

6. The combination of claim 5, the boom including— a personnel bucket located at the upper end of the boom, and a personnel bucket leveling apparatus including a socket located at the upper end of the boom, wherein the jib coupling structure is detachably received within said socket.

7. The combination of claim 5, said jib arm supporting an elongated extension selectively shiftable between a storage position and a use position.

8. The combination of claim 5, further comprising an arm, having first and second ends, disposed between the first and second piston and cylinder assemblies.

9. The combination of claim 8, further comprising first and second mounting units associated with the first and second ends of said arm.

10. The combination of claim 9, said one of the first assembly's rod end and cylinder end being pivotally associated with the base, and the other of said first assembly's rod end and cylinder end being pivotally associated with one of the first and second mounting units.

11. The combination of claim 10, said one of the second assembly's rod end and cylinder end being pivotally associated with the other of said first and second mounting units, and the other of said second assembly's rod end and cylinder end being pivotally associated with the jib arm.

12. An articulating jib unit for selective attachment and detachment with the upper end of a primary boom, said jib unit comprising:

a jib arm;

a base including coupling structure for said selective attachment and detachment of the jib unit to said primary boom upper end; and an articulating assembly operably coupled between said base and jib arm to selectively move the jib arm relative to said base, said assembly including, a first piston and cylinder assembly having a rod end and a cylinder end, a second piston and cylinder assembly having a rod end and a cylinder end and positioned approximately parallel to the first piston and cylinder assembly, substantially parallel arms disposed between the first and second piston and cylinder assemblies, the arms presenting first and second endmost mounting units for mounting of the first and second piston and cylinder assemblies thereto, said first assembly's rod end being pivotally coupled with the base, said first assembly's cylinder end being pivotally coupled with the first endmost mounting unit, said second endmost mounting unit being pivotally connected with the base, said second assembly's cylinder end being pivotally connected with the second endmost mounting unit, and said second assembly's rod end being pivotally associated with the jib arm, such that when both rod ends are generally extended, the first and second piston and cylinder assemblies, the parallel arms, the first and second endmost mounting units, and the base form a general parallelogram.

* * * * *